US005123780A

United States Patent [19]

Martinsen

[11] Patent Number: 5,123,780

[45] Date of Patent: Jun. 23, 1992

[54] PRECAST PERMEABLE BREAKWATER UNIT

[76] Inventor: Ronald E. Martinsen, P.O. Box 367, Queenstown, Md. 21658

[21] Appl. No.: 488,527

[22] Filed: Feb. 28, 1990

Related U.S. Application Data

[63] Continuation of Ser. No. 75,564, Jul. 20, 1987, abandoned.

[51] Int. Cl.[5] ..... E02B 3/06

[52] U.S. Cl. ..... 405/30; 405/25

[58] Field of Search ..... 405/21, 23, 25, 30, 405/31, 34, 35

[56] References Cited

U.S. PATENT DOCUMENTS

| | | | |
|---|---|---|---|
| 478,154 | 7/1892 | Carson | 405/30 X |
| 1,175,962 | 3/1916 | Latham | 405/31 |
| 2,069,715 | 2/1937 | Arpin | 405/25 |
| 3,415,061 | 12/1968 | Staempfli | 405/31 X |
| 3,733,831 | 5/1973 | Sticker | 405/30 |
| 4,129,006 | 12/1978 | Payne | 405/31 |
| 4,341,489 | 7/1982 | Karnas | 405/35 |
| 4,431,337 | 2/1984 | Iwasa | 405/30 |
| 4,439,059 | 3/1984 | Kikuzawa et al. | 405/25 |

FOREIGN PATENT DOCUMENTS

| | | | |
|---|---|---|---|
| 1026496 | 4/1953 | France | 405/31 |

*Primary Examiner*—David H. Corbin

[57] ABSTRACT

A beam- or truss-like reinforced concrete unit to inhibit the erosion of shorelines, sand beaches and river banks by the retardation and diversion of flow across them, intended to be placed on the bottom at right angles to the flow of sand-laden water, without being fastened down. Transverse passages formed by lower chord, upper chord and diagonal members allow water to flow horizontally through the unit, but cause sand to drop out. Diagonal structural members provide great stiffness and strength, despite the presence of the open passages. To increase the fallout of sand, the passages are in two groups which meet at the centerplane of the unit, out of registry with each other, so that each group of passages is obstructed by the diagonal members which form the other group.

10 Claims, 3 Drawing Sheets

FIG. 1
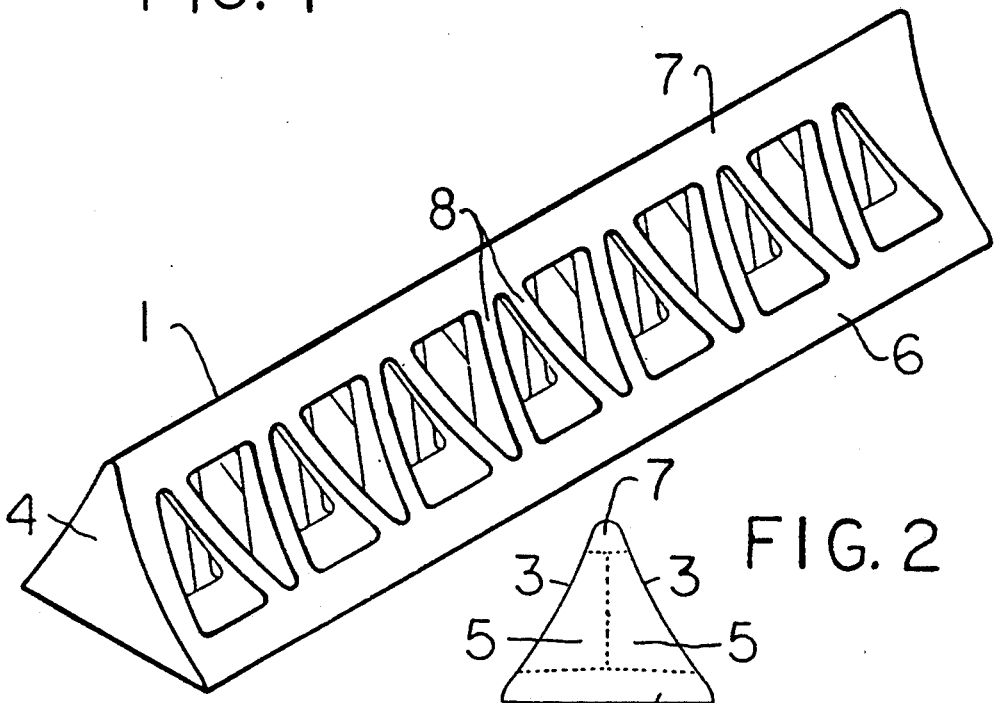
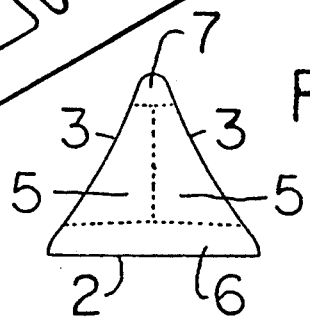
FIG. 2
FIG. 3
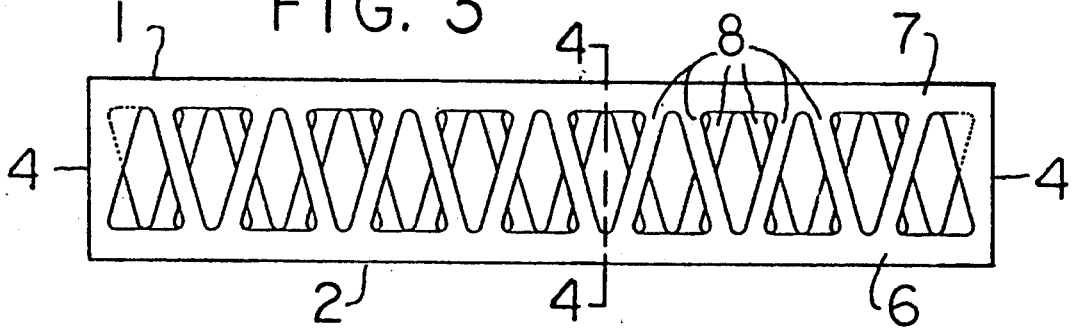

PRECAST PERMEABLE BREAKWATER UNIT

This application is a continuation-in-part of application Ser. No. 07/075,564 filed Jul. 20, 1987, now abandoned.

DESCRIPTION

Background of the Invention

The present invention is the latest in a series of structures whose object is to inhibit the erosion of shorelines, sand beaches or alluvial river banks. It belongs to the subgroup of such structures which operate by causing waves to dissipate their energy by the processes of refraction and reflection, slowing the water which passes through them. As a result of the retardation and diversion of flow, some of the alluvium suspended in the water settles out, either within the structure or close by it.

Recent examples of the type include U.S. Pat. Nos. 4,129,006 and 4,367,978. As waves approach a beach, they entrain sand and carry it about; inward, outward and along the beach. If, on balance, more is taken away than supplied, the beach erodes, and real property disappears, to the distress of owners.

On a shoreline, the rate at which sand moves varies greatly. In calm weather, there may be no movement at all. Moderate weather is characterized by gradual sand movements, while violent storms can cause great and sudden changes.

Structures such as the present invention function by causing some of the transient sand to be deposited at the shoreline, so that the beach builds up in routine, moderate sea conditions. A storm may remove some of the buildup, but even a small net gain, averaged over time, will preserve and eventually enlarge the beach.

A similar process occurs in rivers on alluvial plains. A river current is nearly always swift enough to pick up the finest sediments, but, in times of high water or floods, even quite coarse material moves, and the rate is much faster. The result is that river bends migrate, eating up A's land and adding to B's, damaging buildings, washing roads away, etc.

It has been said of structures such as the present invention, "Anything will collect sand, for a while." The implication is that, whereas such structures may vary in ability to collect sand, they vary more importantly in ability to survive storms, to stay where put, and to resist the attacks of sunlight, ice, water and other destructive agents.

To be satisfactory, a structure of this type must strike the right balance; having low enough cost, high enough durability, and the proper configuration and permeability to cause the beach to build up, on average over time.

SUMMARY OF THE INVENTION

To cause a beach to build up, the permeable breakwaters must be of adequate size and installed in the right places on that beach. The present invention is not concerned with such site-specific installation problems, but rather with the construction of the device proper and with ease of installation generally.

The object of the present invention is, at a given level of ability to cause sand to collect, to achieve a more favorable balance between installed cost and durability of the installation.

A typical installation is a longshore barrier a short distance out in the water, consisting of a series of breakwater units made according to this invention and placed end to end, with clearance between adjacent units engineered to allow for economy of installation.

The units may also be used to form groins, as they are called on beaches, or dikes, as similar constructions are called on rivers. For this purpose, they would be placed end to end approximately at right angles to the shoreline, rather than along it.

The precast permeable breakwater unit is an elongate, flat-bottomed reinforced concrete casting having all the attributes of a structural beam. The sand-accreting feature is multiple, semi-blocked passages through the unit, substantially horizontal and at right angles to the long dimension of the unit.

Regarding the size of the passages, the least size that would give satisfactory sand-catching action is about fifteen percent of the entire lateral area of the beam, measured from the bottom up as projected on a vertical plane running parallel to the unit. This is the net area of side-to-side passageway, not the larger area of a single group of passages.

BRIEF DESCRIPTION OF THE DRAWINGS

FIG. 1 is an overall view of a unit of the invention, as one would see it sitting on a beach.

FIG. 2 is an end view of the unit, and FIG. 3 shows the unit in elevation.

DETAILED DESCRIPTION OF THE INVENTION

Figure 4:
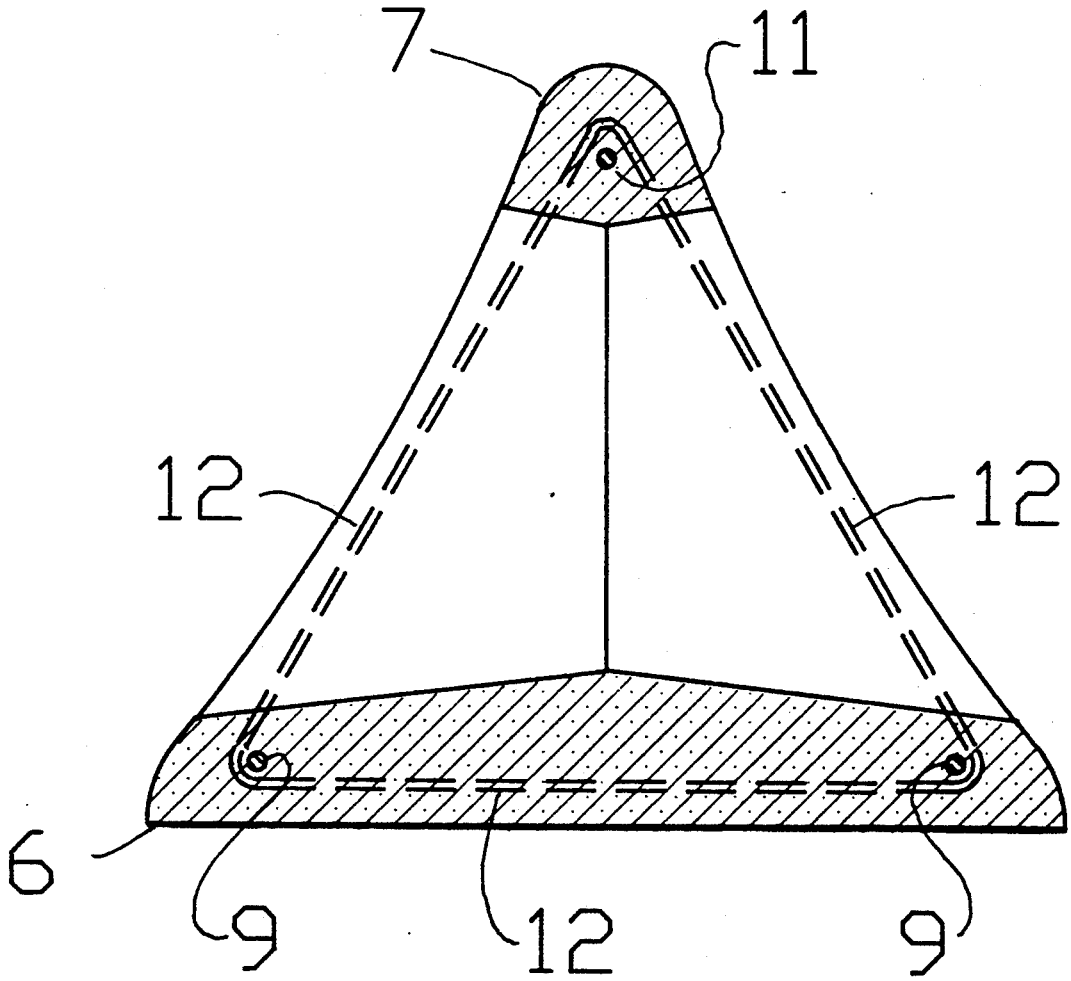
FIG. 4 is a typical cross-section through the unit, the purpose of which is to show how it is reinforced.

FIG. 1 shows the appearance of an emplaced unit 1 of the invention. Units are simply set upon the underwater part of the beach. They need not be fastened, not to each other, and not to the beach. The beach needs no preparation. All this greatly facilitates installation.

Unit 1's bending strength, in particular, allows it to be handled and transported by normal equipment, with no special measures required. On site, it can be set upon the beach, even if the beach is uneven and supports it only here and there. The breakwater unit will bridge gaps between points of support until some combination of scouring and its own weight has settled it down into a final position.

A typical installation is a barrier composed of multiple units 1 placed end to end, but not touching, on a beach, in the water near shore. At tidal sites, normal low water should fall down near the bottom of unit 1.

The cross section of unit 1, as shown on FIG. 2, is substantially triangular, with bottom flat and two sides slightly concave. In this preferred embodiment, the unit is widest at the base and converges towards the top. The resulting low center of gravity helps to keep unit 1 in place when the larger waves overtop it.

While this is an advantage, the exact shape of the sides is not critical, and any cross section of unit 1 having a substantially flat bottom is within the scope of the present invention. The unit might, for instance, have a flat top, narrower than the base, or even a rectangular or semi-circular cross section.

More important than details of cross-sectional shape is the fact that a unit of the present invention, because of its strength as a beam, can be given a length many times its width. This helps to keep the unit in place. The crest of a wave may hit only one part of a unit, but the unit's entire weight and base resist being moved.

Unit 1 may be thought of as a barrier which is solid, except for lateral penetrations. Regarded in this light, it has a flat bottom 2, two upwardly convergent sides 3, flat vertical ends 4, and multiple horizontal penetrations 5.

Penetrations 5 are substantially triangular in cross section and all at the same height. On each side of unit 1, they are arranged with base of triangle alternately up and down, so as to fit compactly together, as shown on FIG. 3. Each penetration goes only halfway through, to the centerplane of unit 1, as shown on FIG. 2.

The lateral penetrations could take other shapes as well, such as round holes, of the same size or of various sizes. In shaping penetrations, it is well to avoid sharp internal corners, because they tend to induce cracks.

While each side 3 has a similar array of penetrations 5, the two arrays are out of registry with each other. As best shown on FIG. 3, a penetration having its base down always meets, at the centerplane of unit 1, a penetration from the other side having its base up, and vice versa.

Taken together, penetrations from the two sides form irregular, obstructed passages through unit 1. Water seeking to pass through unit 1 is therefore made to follow circuitous paths, and to lose velocity. As a result, some of the sand entrained in the water settles out.

The conception of unit 1 as a barrier with penetrations is consistent with the best method of manufacturing it, which is to cast it upside down, in a mold, in one piece. In this economical process, the upper surface of the concrete which has been poured into the mold forms base 2. Great effort need not be exerted to smooth base 2, because a degree of roughness there is helpful in keeping unit 1 in place.

But unit 1 can also be thought of as a double truss, a conception which better illustrates its strength and structural integrity. Seen as a truss, unit 1 has a wide and heavy lower chord 6, a much smaller upper chord 7, and multiple diagonal members 8.

Diagonal members 8 are in two arrays, one to either side of unit 1, with inner edges touching at unit 1's centerplane wherever members 8 cross. Each array consists of members 8 inclined by equal angles from the vertical, alternately the one way and the other, so that the members 8 on either side form a zigzag pattern from one end of unit 1 to the other.

The two zigzag patterns have a common pitch, but are shifted lengthwise so as to be out of registry with each other by half a pitch. Unit 1 terminates in two solid end pieces 4. Each piece 4 is flat outside, but shaped inside like a pair of oppositely inclined diagonal members 8.

Unit 1 thus forms a pair of trusses, fastened side by side so as to share lower chord 6 and upper chord 7, but each having its own set of diagonal members 8. Members 8 do double duty, as refraction plates and as structural members. Because they serve as structural members, the concrete parts of unit 1 all require reinforcement to sustain tensile loads. FIG. 4, a cross section through 1, shows steel reinforcement according to good current practice.

Lower chord 6 has a pair of pre- or post-tensioned rods 9, which run the length of the unit in the positions shown. Upper chord 7 is similarly equipped with tensioned rod 11. As to the tensioning of rods, unit 1 may be made by any of several procedures used to manufacture light poles, piles, beams, and other elongated concrete products.

By keeping the unit in compression, the tensioned rods 9 and 11 prevent cracks from opening. This helps greatly to keep salt water away from the reinforcing steel and to minimize damage by ice, all of which prolongs the unit's service life.

Base 6 is also reinforced transversely by steel bars 12, which may be coated with epoxy resin or treated some other way to prevent corrosion. Similar bars 12 reinforce diagonal members 8, with one bar 12 per member 8 or more.

Reinforcing bars 12 are shown hooked around tensioned rods 9 and 11. This makes the structure more reliable. For instance, it makes it possible to lift unit 1 in one piece by upper chord 7, even if severely damaged.

Figure 5:
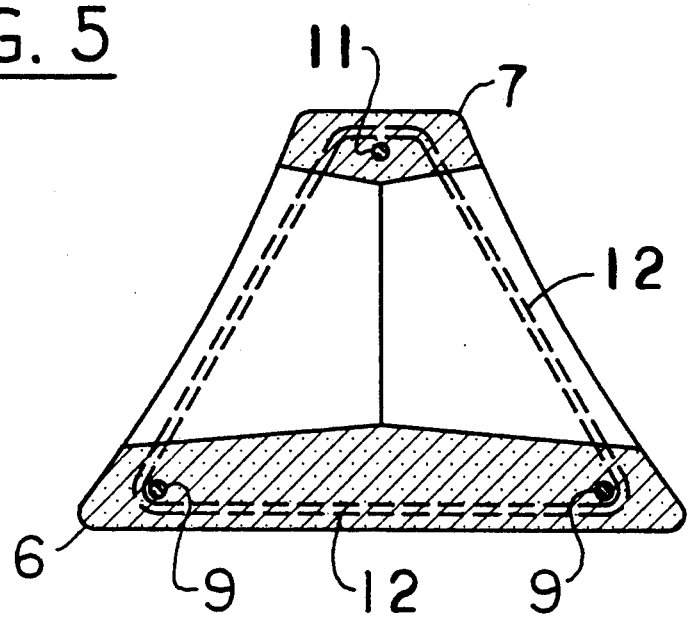
FIG. 5 is like FIG. 4, except that it shows a unit of trapezoidal cross section.

FIG. 5 shows the same construction as FIG. 4, except that the top of upper chord 7 is flattened, making the cross section of unit 1 substantially trapezoidal.

Figure 6:
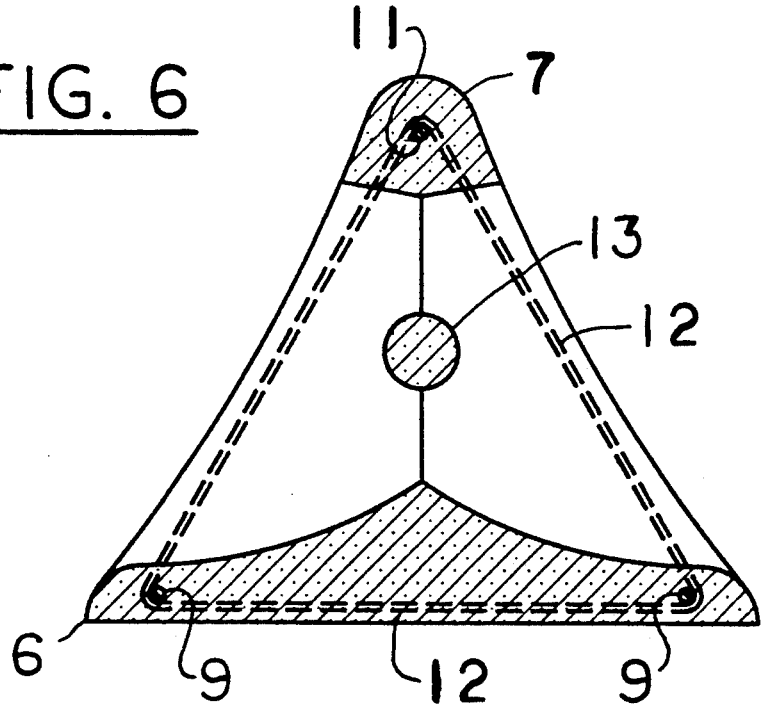
FIG. 6 is like FIG. 4, except for two features: The shape of the upper surface of the base is modified. A round rod is placed axially near the center of the unit.

FIG. 6 is also like FIG. 4, except for two modifications. The upper surface of lower chord 6 is continuously curved as to be lower at the outside edges and higher at the center, compared to FIG. 4, assuming the base to have the same volume in both FIGS. This improves the dissipation of the energy of waves high enough to enter the transverse passages, but not high enough to fill them. This includes most waves, if the size of unit 1 is correct for its site.

The other modification is the addition of rod 13, placed axially near the center of unit 1. Rod 13 runs through all the transverse passages, providing additional blockage. By its use, more blockage can be provided by less concrete, than if the concrete were used in diagonal members 8 only.

Rod 13 need not be round, as shown. Any curved or polygonal cross section will serve, provided it is thick and strong. Feature 13 provides one more way the adjust the design of the unit.

The three additional features of FIGS. 5 and 6 are independent and may be used in any combination.

Given good materials and workmanship, a breakwater unit according to this invention is very strong and durable. It can be lifted by the ends or middle, and can be set down on any natural surface, all without fear of damage. Moreover, it is an economical one-piece reinforced concrete casting, made by the use of standard industrial procedures.

The material of choice for the present invention is reinforced concrete, where the word "reinforced" is taken in the general sense to include all materials added by whatever procedure to increase the tensile strength of the concrete.

As discussed above, it is desirable that pre- or post-tensioned reinforcing rods be used in the longitudinal or spanwise direction of the beam-like unit 1, so that the unit is kept always in longitudinal compression. However, a unit 1 having only untensioned reinforcement would accumulate sand just as well, though it would not survive as much punishment, and might not last as long, as a properly tensioned member.

It should also be understood that equivalent materials are included in the scope of the invention. At this writing, satisfactory physical equivalents exist, but are undersirable because of being more costly.

I claim:

1. A unit to inhibit the erosion of sand beaches and river banks by the retardation and diversion of flow across them, comprising: an elongated, reinforced concrete beam, having a substantially flat bottom, and multiple penetrations into said beam substantially parallel to said bottom and at right angles to said beam's length, said penetrations being in two similar groups which penetrate said beam from opposite sides and meet inside said beam, said groups being out of registry so that said penetrations form obstructed and irregular passages from side to side through said beam, wherein the minimum clear areas of said passages, net of obstructions, sum to at least fifteen percent of the area of said beam, viewed from the side.

2. A unit as recited in claim 1, wherein said penetrations have substantially the same triangular cross section and are arrayed horizontally along said beam with the bases of said triangular penetrations alternately up and down, so that the beam material remaining between said penetrations forms diagonal structural members which are inclined alternately one way and the other from a normal to said base, giving said beam as a whole the general appearances of a bridge truss, except that said groups of penetrations from said opposite sides of said beam are out of registry.

3. A unit as recited in claim 2, wherein the cross section of said beam is widest at said bottom.

4. A unit as recited in claim 3, wherein the cross section of said beam is substantially triangular.

5. A unit as recited in claim 3, wherein the cross section of said beam is substantially trapezoidal.

6. A unit to inhibit the erosion of sand beaches and river banks by the retardation and diversion of flow across them, comprising: an elongated truss of reinforced concrete cast in one piece, having an upper chord, a lower chord with substantially flat bottom, and multiple diagonal members connecting said upper chord to said lower chord, wherein, as viewed horizontally from a side of said truss, at least some of said diagonal members on one side of said truss cross other said diagonal members on the other side of said truss, so that side-to-side passages through said truss are obstructed and irregular, wherein the clear areas of said passages, measured in the centerplane of said truss and net of obstructions, sum to at least fifteen percent of the lateral area of said truss, measured in said centerplane above said substantially flat bottom.

7. A unit as recited in claim 6, wherein the cross section of said truss is widest at said bottom.

8. A unit as recited in claim 7, wherein the cross section of said truss is substantially triangular.

9. A unit as recited in claim 7, wherein the cross section of said truss is substantially trapezoidal.

10. A unit as recited in claim 7, having an axial rod which passes through and partially obstructs said side-to-side passages through said truss.

* * * * *